US008727394B2

(12) United States Patent
Beckner

(10) Patent No.: US 8,727,394 B2
(45) Date of Patent: May 20, 2014

(54) BUTTON LATCH

(75) Inventor: Mark Beckner, Wildomar, CA (US)

(73) Assignee: Ryadon, Inc., Foothill Ranch, CA (US)

( * ) Notice: Subject to any disclaimer, the term of this patent is extended or adjusted under 35 U.S.C. 154(b) by 457 days.

(21) Appl. No.: 13/010,330

(22) Filed: Jan. 20, 2011

(65) Prior Publication Data

US 2012/0187702 A1 Jul. 26, 2012

(51) Int. Cl.
*E05C 1/12* (2006.01)

(52) U.S. Cl.
USPC ..... 292/164; 292/162; 292/DIG. 54; 292/DIG. 53

(58) Field of Classification Search
USPC ..... 292/162–164, 137, 145, 150, 302, 292/DIG. 54, DIG. 53
See application file for complete search history.

(56) References Cited

U.S. PATENT DOCUMENTS

| | | | | | |
|---|---|---|---|---|---|
| 929,638 | A | * | 7/1909 | Voight | 70/107 |
| 4,995,652 | A | * | 2/1991 | Mugnolo et al. | 292/202 |
| 6,161,404 | A | * | 12/2000 | Westwinkel | 70/370 |
| D491,045 | S | * | 6/2004 | Laabs et al. | D8/343 |

* cited by examiner

*Primary Examiner* — Mark Williams
(74) *Attorney, Agent, or Firm* — Fulwider Patton LLP

(57) ABSTRACT

An improved button-type latch to releasably secure a door, having a spring loaded latch bolt retained within a cylindrical housing. The housing further comprises a pair of leaf springs longitudinally directed toward a front of the button latch, the leaf springs cooperating with a retaining lip on the housing to capture a structure surface to maintain the button latch therein.

3 Claims, 2 Drawing Sheets

FIG. 1
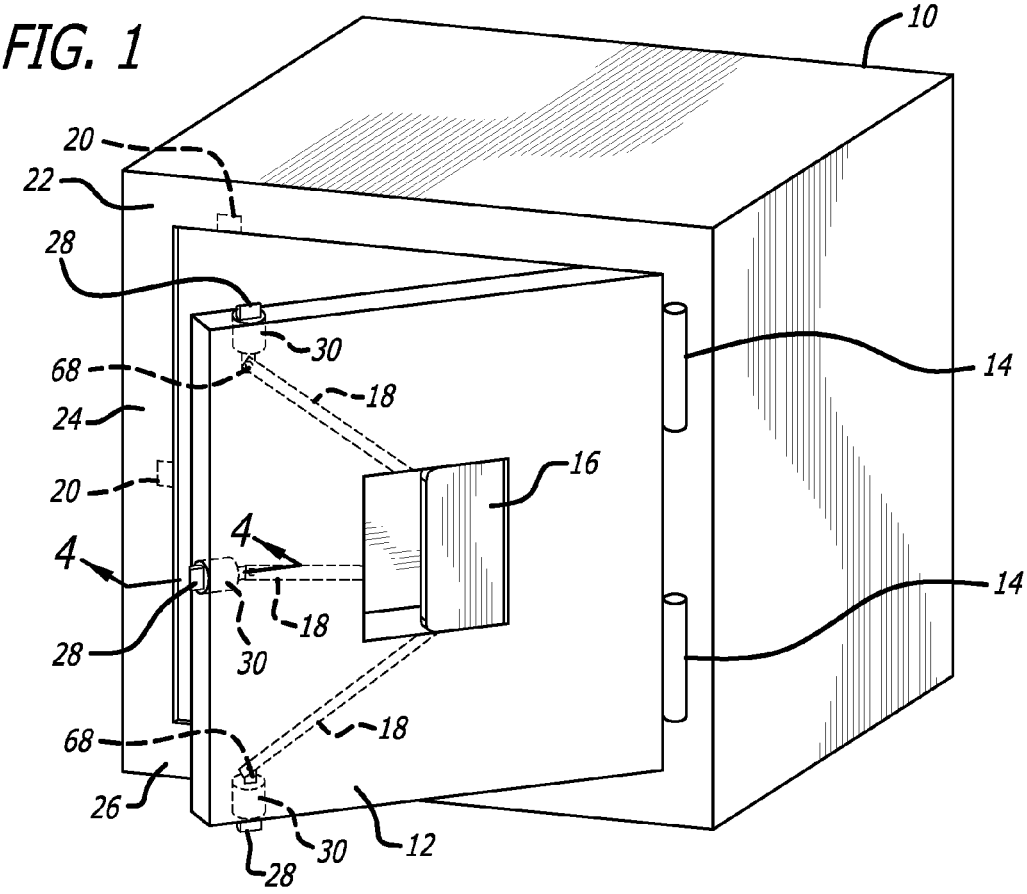
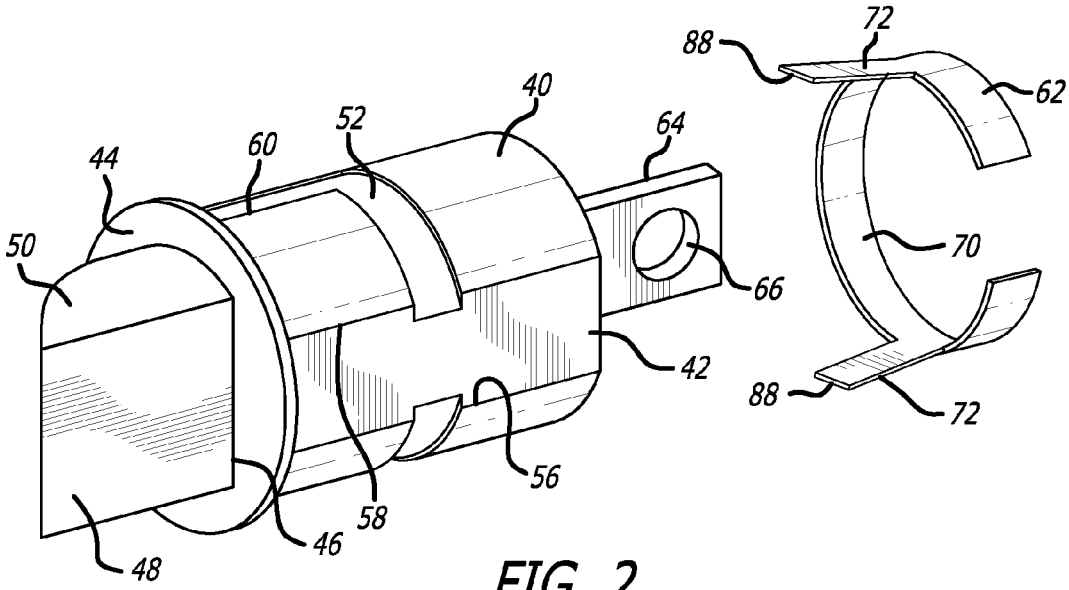
FIG. 2

BUTTON LATCH

BACKGROUND

Cabinetry and dressers are often times fitted with latching mechanisms that allow the drawers or doors of the cabinet to maintain a shut position. As the doors or drawers close, a spring loaded latched releases into a catch or cavity and prevents the door or drawer from opening until a handle is released or some other opening mechanism is activated. These may be paddle-type releases, such as those sold by the assignee of the present invention Ryadon Inc. of Foothill Ranch, Calif. These latching mechanisms are well known in the art, and an assortment of these latching mechanisms are shown at http://www.ryadon.com/latches.

One example of a latching mechanism for a cabinet or drawers is a button latch. Button latches typically have cylindrical housings with a spring loaded, beveled latch bolt mounted in the housing for retraction therein. The beveled front edge of the latch bolt is designed to make contact with the surface of the latch and cause the latch bolt to retreat into the housing of the button latch against the biasing of the spring. The latch bolt continues to retreat into the housing as the surface bears against the latch bolt until the latch bolt clears the surface. A cavity sized to receive the latch bolt captures the latch bolt as the spring, no longer compressed by the cabinet surface, releases to secure the drawer or door to the cabinet. The latch bolt may have a tab that projects out of the opposite end of the housing, such that retraction of the tab by a handle or the like withdraws the latch bolt back into the housing. In this event, the door may then again be opened as the interference between the latch bolt and the cabinet is eliminated when the latch bolt is withdrawn.

The foregoing operation and structure is well known in the art. However, because the button latches have substantially cylindrical housings that are inserted into a bore in the cabinet or dresser door/drawer, it is prone to loosening as the drawer/door is repeated opened and closed with the inherent jarring that occurs. As the button latch loosens, it can then become dislodged from the cabinet and there is little that can be done to prevent further detachments. Accordingly, what is needed is a mechanism for preventing a button latch from becoming dislodged once placed in a cabinet, dresser, housing, or the like.

SUMMARY OF THE INVENTION

The present invention is a button-type latch having a housing that retain a spring-loaded latch bolt for releasable deployment in a socket or cavity, and where the latch bolt further includes a release tab that can be coupled to a bar or handle to withdraw the latch bolt and release the button latch. The housing is substantially cylindrical with an annular outer lip at a first end adjacent the projecting portion of the latch bolt, said outer lip adapted to bear against a surface of the door or drawer to provide a stop that limits the further ingress of the button latch into its designated fitting. As is customary, a portion of the cylindrical housing may have a flat portion extending the length of the housing from the lip to the opposite end. The housing of the present invention further comprises a circumferential recess extending around the perimeter, terminating at the respective sides of the flattened portion. The recess further includes first and second channels extending forward from the recess to the lip. The recess holds a leaf spring clip having a circumferential band sized to be retained in the circumferential portion of the recess, and first and second leaf spring extending forward toward the lip of the housing. The leaf springs angle slightly out (in the radial direction) of the forward positioned channels in an undeformed condition, but the leaf springs can be depressed into their respective channels.

In use, the button latch is inserted into a fitted aperture corresponding to the shape of the housing's profile. The button latch will insert into the aperture until the circumferential band of the leaf spring clip, whereupon the leaf springs begin to bear against the sides of the aperture with increasing resistance as the leaf springs are compressed. There is a small gap between the ends of the leaf springs and the inner surface of the housing's lip, that is selected to be slightly larger than the thickness of the panel or door that the button latch is being inserted into. When the button latch is fully inserted into the aperture such that the inner surface of the lip is flush against the outer surface of the door or drawer, the leaf springs clear the edge of the door and separate, trapping the edge of the door between the leaf springs and the lip of the housing. In this manner, the button latch is captured in a reliable manner and cannot easily be dislodged or removed from the aperture.

BRIEF DESCRIPTION OF THE DRAWINGS

FIG. 1 is a perspective view of a cabinet with a handle release and three button latches of an embodiment of the present invention;

FIG. 2 is a perspective, exploded view of the button latch housing and circumferential leaf spring band illustrating the circumferential recess and longitudinal channels;

DETAILED DESCRIPTION OF THE PREFERRED EMBODIMENTS

Figure 3:
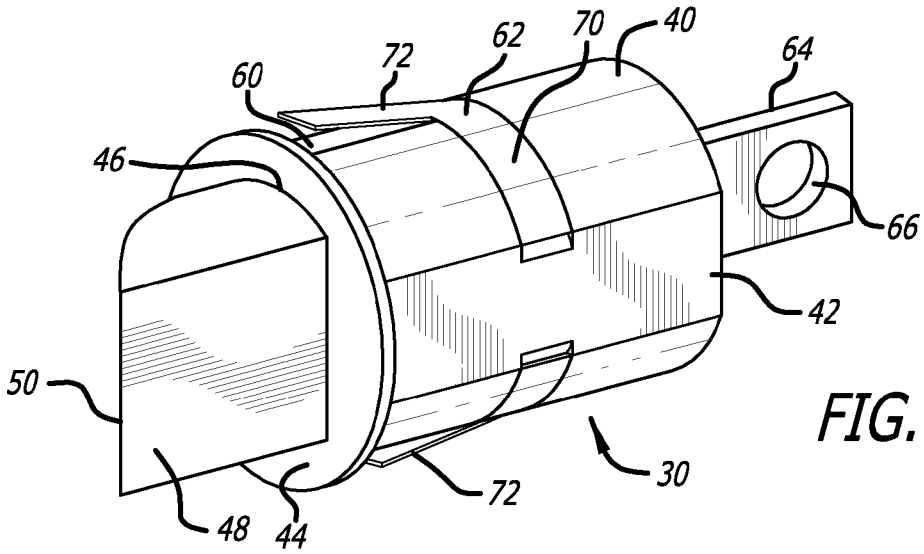
FIG. 3 is perspective view of the button latch of FIG. 2 showing the leaf springs in their unbiased or undeformed condition.

FIG. 1 illustrates a cabinet 10 having a pivoting door 12 connected by two hinges 14 that allows the door 12 to open and close inside the opening of the cabinet. The door 12 includes a release handle 16 in the shape of a paddle that can be manually actuated by pulling the handle away from the door. The handle is connected to a series of pull-rods 18 that are used to retract the latch bolts in the button latches. The door's handle can simultaneously retract three different button latches at once using the three pull-rods 18 shown. The cabinet also includes three cavities 20 sized to receive the latch bolts 28 from the button latches 30 in the top surface 22, the side wall 24, and the bottom surface 26.

The button latch 30 is shown in FIGS. 2 and 3, and includes a hollow, generally cylindrical housing 40 defining a longitudinal axis. The housing is circular in profile except a rectangular face 42. The aft surface of the housing includes a slot (not shown) that allows a release tab 64 on the latch bolt 50 to extend. At a forward edge of the housing is an annular lip 44 having a cut-out 46 shaped to receive the beveled projecting head 48 of the latch bolt 50. The annular lip 44 operates to position the button latch 30 in the cabinet 10 as set forth below. The housing 40 further comprises a cylindrical recess 52 spaced from the annular lip 44 in the longitudinal direction, where the cylindrical recess 52 has a depth D. In a preferred embodiment, the cylindrical recess 52 extends around the housing 40 from one edge 56 of the rectangular face 42 to the other edge 58 of the rectangular face 42. The housing also includes at least two channels 60 that have an approximate depth of D and extends from the circumferential recess 52 to the annular lip 44. The circumferential recess 52 and channels 60 form a guide for a leaf spring clip 62 that fits over the housing and is seated in the circumferential recess 52 and channels 60.

The housing holds a latch bolt 50 in the interior that is biased by a spring (not shown) so as to project out of the housing as shown. Connected to the latch bolt 50 is a release tab 64 having a hole 66 for receiving a pin 68 that couples the latch bolt 50 to the associated pull-rod 18. In operation, when the handle 16 is pulled, it causes the pull-rods 18 to retract. This movement of the pull-rods 18 applies a tension force on the release tab 64 against the force of the biasing spring (not shown) in the housing 40. The spring collapses, and the latch bolt 50 that is connected to the release tab 64 is withdrawn into the housing, allowing the door to be released from its captured position.

In FIG. 3, the leaf spring clip 62 is shown on the housing 40, received in the circumferential recess 52. The leaf spring clip 62 is formed of a circumferential band 70 and a pair of leaf springs 72 depending from the circumferential band in a longitudinal direction, about one hundred and eighty degrees apart. The leaf springs 72 are not parallel, but open outward slightly as they extend away from the circumferential band 70 in an undeformed condition. The leaf springs 72 should have some resiliency, such that when they are pressed radially inward they flex back out to their undeformed condition when the compressive force is removed. The leaf springs sit in and above the channels 60, such that the leaf springs 72 can be pressed into the channels 60 during installation of the button latch 30 and not increase the profile of the latch.

Figure 4:
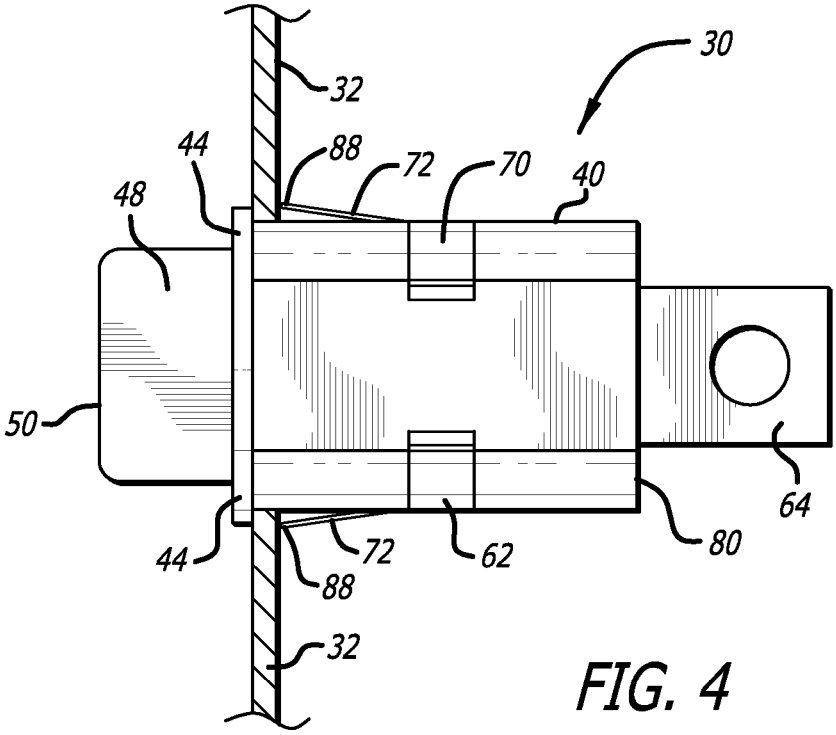
FIG. 4 is an enlarged, side view taken along lines 4-4 of FIG. 1 showing the button latch captured in the door of the cabinet.

FIG. 4 is taken along lines 4-4 of FIG. 1 and shows the button latch 30 mounted to the cabinet 10. The button latch 30 is shown installed in the cabinet 10 at an opening shaped to receive the button latch. The opening is defined by a retaining surface 32 that is formed from a relatively stiff, thin material such as steel or aluminum. The manner in which the button latch 30 is secured to the retaining surface 32 is illustrated in FIG. 4. As the button latch 30 is inserted into the opening of the cabinet, the release tab 64 passes through the opening first, followed by the back edge 80 of the housing 40. As the housing continues to pass through the opening, the leaf spring clip 62 is reached. Because the circumferential band 70 sits in the circumferential recess 52 of the housing 40, there is no discontinuity in the profile of the housing and it continues to pass through the opening. However, further insertion of the button latch causing the retaining surface 32 to bear against the leaf springs 72, forcing the leaf springs radially inward as the button latch passes through the opening. The leaf springs 72 are compressed into the recesses 60 of the housing 40 as the leaf springs pass through the opening of the cabinet. When the leaf springs 72 clear the opening, which should occur as the annular lip 44 makes contact with the retaining surface 32, the leaf springs 72 release to their unbiased or undeformed condition slightly splayed outward. As shown in FIG. 4, the retaining surface 32 is thus captured between the annular lip 44 of the housing 40 and the ends 88 of the leaf springs 72. The button latch 30 is thus fixed in the cabinet opening, and the clip 62 prevents the button latch from loosening or becoming dislodged.

I claim:

1. A button latch for releasably securing a first structure into a second structure, the button latch retained in an opening of the first structure at a first surface, the button latch comprising:

a hollow housing having a substantially cylindrical wall defining a longitudinal axis along the housing, the substantially cylindrical wall terminating at a first end in a radially outwardly protruding retaining lip, the substantially cylindrical wall including a circumferential recess spaced from the retaining lip and first and second channels extending longitudinally forward from the circumferential recess to the retaining lip;

a latch bolt housed in the hollow housing having a first end and a release tab at a second end, the release tab protruding rearwardly from the housing, and the first end of the latch bolt extending through a mouth of the housing; and a leaf spring clip having a circumferential band sized to be disposed within said circumferential recess and wrap around said housing, the leaf spring clip further comprising first and second leaf springs extending longitudinally above the first and second channels of the housing, respectively, where the leaf springs in an unbiased condition angle out of their respective channels;

whereby insertion of the button latch compresses the leaf springs into respective channels.

2. The button latch of claim 1 wherein the housing includes a rectangular side edge and is otherwise circumferential in profile.

3. The button latch of claim 1 wherein the first end of the latch bolt is beveled.

* * * * *